United States Patent [19]

Dubrinsky et al.

[11] Patent Number: 4,655,447

[45] Date of Patent: Apr. 7, 1987

[54] TREADMILL ASSEMBLY

[76] Inventors: Max M. Dubrinsky, 6324 Rose Blvd., West Bloomfield, Mich. 48033; Mary S. Edwards, 6478 Rustic Ridge Trail, Grand Blanc, Mich. 48439

[21] Appl. No.: 761,796

[22] Filed: Aug. 2, 1985

[51] Int. Cl.[4] ..... A63B 23/06; A63B 1/00

[52] U.S. Cl. ..... 272/69; 272/70

[58] Field of Search ..... 272/70, 70 A, 69, 89

[56] References Cited

U.S. PATENT DOCUMENTS

| | | | |
|---|---|---|---|
| 157,817 | 12/1974 | Haney et al. | 272/89 |
| 2,819,755 | 1/1958 | Berger et al. | 272/70 A |
| 2,892,455 | 6/1959 | Hutton | 272/70 |
| 3,761,082 | 9/1973 | Barthel, Jr. | 272/70 A |
| 4,342,452 | 8/1982 | Summa | 272/69 |
| 4,374,587 | 2/1983 | Ogden | 272/69 |
| 4,416,293 | 11/1983 | Anderson et al. | 272/69 |

FOREIGN PATENT DOCUMENTS

| | | | |
|---|---|---|---|
| 9426 | of 1910 | United Kingdom | 272/70 A |

*Primary Examiner*—Richard J. Apley
*Assistant Examiner*—H. Macey
*Attorney, Agent, or Firm*—Cullen, Sloman, Cantor, Grauer, Scott & Rutherford

[57] ABSTRACT

A treadmill assembly of the type including a frame, an endless generally horizontally disposed belt positioned generally at the base of the frame, a motor for driving the belt at varying speeds and a handle at the front end of and spaced above the belt so that a uscr running on the motorized belt may grasp the handle with his hands. A safety harness is provided for use with the treadmill assembly and includes a pair of straps adapted to be supported from support structure over the treadmill and each including a loop portion at its lower end adapted to pass through the groin of the user. The safety harness further includes a catch band extending transversely between the rear sections of the loop portions of the straps at a vertical location such as to position the band behind the user generally in the central region of the user's back. The catch band and the loop portions at the lower ends of the straps coact in the event of collapse of the user while running on the treadmill to catch the user in a generally seated position and prevent injury to the user resulting from falling off of or onto the moving treadmill. Adjustment assemblies in the form of coacting seatbelt members are provided to both adjust the overall height of the safety harness to suit users of varying heights and to adjust the length of the loop portions of the straps to suit users of varying bodily configurations.

8 Claims, 4 Drawing Figures

TREADMILL ASSEMBLY

DESCRIPTION

BACKGROUND OF THE INVENTION

This invention relates to treadmill type exercise devices and more particularly to a safety harness especially adapted for use with a treadmill exercise apparatus to prevent injury to the user in the event of collapse while using the treadmill.

Motorized treadmills today enjoy wide use as exercise devices or as a means of administering "stress tests." When administering a stress test, the user is typically hooked up to an electrocardiogram apparatus and the cardiovascular response of the user is recorded as the speed of the motorized belt of the treadmill is gradually increased and/or the inclination of the belt is gradually increased. Whereas the stress tests are very useful as a means of identifying possible circulatory deficiencies and as a means of quantifying the cardiovascular fitness of the user, they pose a potential danger in that users on occasion are overstressed and collapse while using the treadmill with resultant injury to the user caused by falling onto the still moving treadmill and/or falling totally off of the treadmill and onto the adjacent hard support surface.

SUMMARY OF THE INVENTION

This invention is directed to the provision of a treadmill assembly in which means are provided to prevent injury to the user of the treadmill in the event of collapse of the user while running on the treadmill.

The invention is intended for use with a treadmill assembly of the type including a frame, an endless generally horizontally disposed belt positioned generally at the base of the frame, a motor for driving the belt at varying speeds, and a handle at the front end of and spaced above the belt so that a user running on the motorized belt may grasp the handle with this hands. According to the invention, the treadmill assembly further includes support means positioned over the belt rearwardly of the handle and a safety harness suspended from the support means and adapted to be fitted over the user in a manner to allow free running movement of the user on the belt while providing a catch mechanism in the event of collapse of the user while running on the belt.

According to a further feature of the invention, the safety harness includes strap means adapted to embrace front and rear portions of the body of a user of the treadmill in a manner to allow free movement of the user on the treadmill and catch means positioned behind the user and operative in response to collapse of the user while exercising on the treadmill to catch the user in a seated position and prevent the user from falling onto or off of the treadmill with consequent bodily injury.

According to a further feature of the invention, the strap means includes a pair of straps adapted to be supported from the support means and each including a loop portion at its lower end adapted to pass through the groin of the user and the catch means comprises a catch band extending transversely between the straps at a vertical location such as to position the band behind the user generally in the central region of the user's back.

According to a further feature of the invention, adjustment means are provided in each strap between the support means and the loop portion so that the straps may be adjusted in length to adjust the general height of the straps to accommodate users of varying heights.

According to a further feature of the invention, further adjustment means are provided in the loop portion of each strap so that the loop may be adjusted in length to accommodate users of varying bodily configurations.

In the disclosed embodiment of the invention, each loop portion of each strap includes a front section and a rear section; the catch band extends transversely between the rear sections of the loop portions; and the adjustment means in the upper portions of the strap and in the loop portions each comprise male and female seatbelt members snappingly secured together and adjustable in known manner to provide selective adjustability in vertical height of the harness and in length of the loop portions.

In one disclosed embodiment of the invention, the overhead support means comprises means adapted to be secured in the ceiling over the treadmill.

In a further embodiment of the invention, the overhead support means comprises a floor mounted frame structure extending upwardly and including a top cross member to which the straps are attached.

In a further embodiment of the invention, the support means comprises a frame structure mounted on and extending upwardly from the frame of the treadmill.

DETAILED DESCRIPTION OF THE PREFERRED EMBODIMENTS

Figure 1:
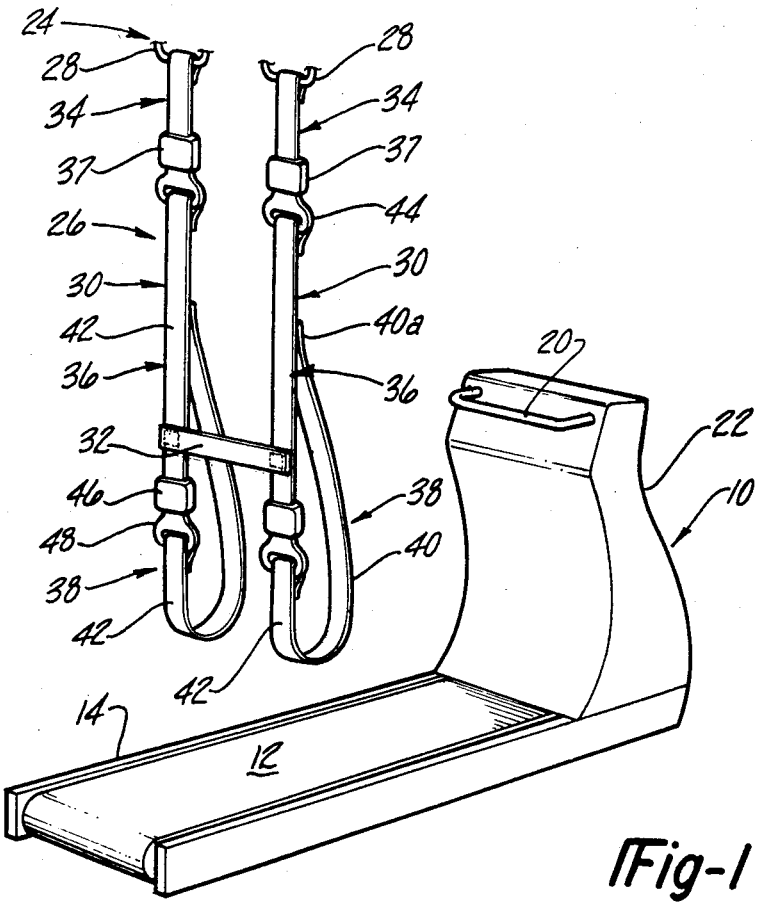
FIG. 1 is a perspective view of the invention treadmill assembly showing a ceiling mount for the safety harness of the invention.

The invention is intended for use with a treadmill assembly of the type including a frame structure 10; an endless belt 12 positioned between side rails 14 and 16 of the frame structure; an electric motor 18 positioned within the frame structure and adapted to selectively drive endless belt 12 at varying speeds; and a handle 20 positioned at the front end of the treadmill and secured to the upper end of the front pedestal portion 22 of the frame structure 10. Means (not shown) are also provided to selectively raise the height of the front end of belt 12 so that, in the course of administering a stress test, the effort required of the user to keep pace with the belt is progressively increased until the maximum cardiovascular capacity of the user is determined as a function of belt speed and the angle of inclination of the belt.

The invention treadmill further includes overhead support means 24 and a safety harness seen generally at 26.

Figure 2:
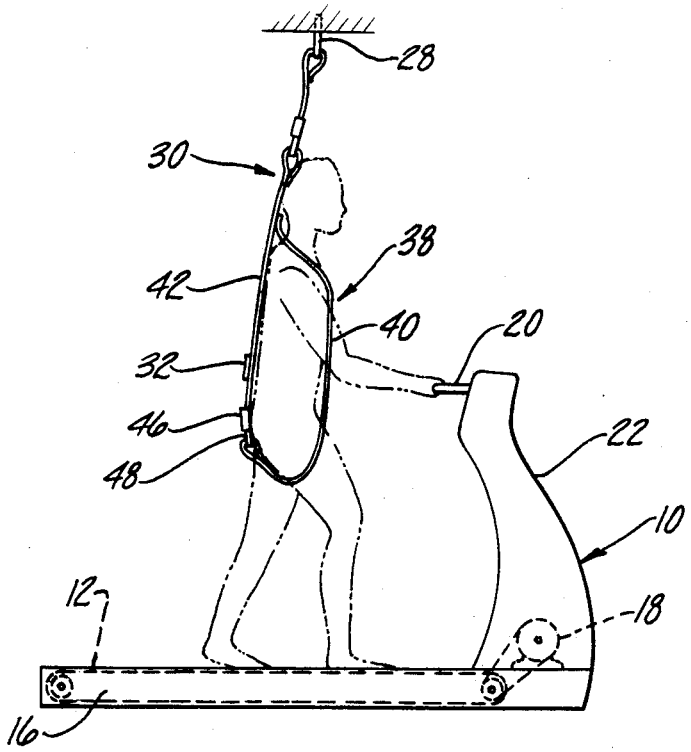
FIG. 2 is a side elevational view of the invention treadmill of FIG. 1.

In the invention embodiment seen in FIGS. 1 and 2, support means 24 comprises a pair of U bolt members 28 suitably secured in the ceiling over belt 12 rearwardly of the front end of the treadmill.

Safety harness 26 includes a pair of straps 30 and a catch band 32.

Each strap 30 is formed of a fabric material and includes an upper portion 34 and a lower portion 36. Upper portion 34 is suitably looped at its upper end over a respective U bolt 28 and carries an adjustable female seatbelt member 37 at its lower end. The lower portion 36 of each strap is formed into a loop 38 with each loop including a front section 40 and a rear section 42. The upper end 40*a* of front section 40 is secured as by sewing to the rear section 42 of the respective strap. A male seatbelt member 44 is secured to the upper end of each lower strap portion 30 for coaction with the associated seatbelt member 37 carried at the lower end of the associated upper strap portion 34. Further male and female seatbelt members 46 and 48 are provided in the rear section 42 of each loop portion 38 of each strap. Catch band 32 extends transversely between the rear sections 42 of the loop portions of the straps at a location beneath the points of joinder 40*a* of the upper ends of the front sections 40 of the loop portions 38 to the rear sections 42 of the loop portion and above female seatbelt buckles 46.

Figure 3:
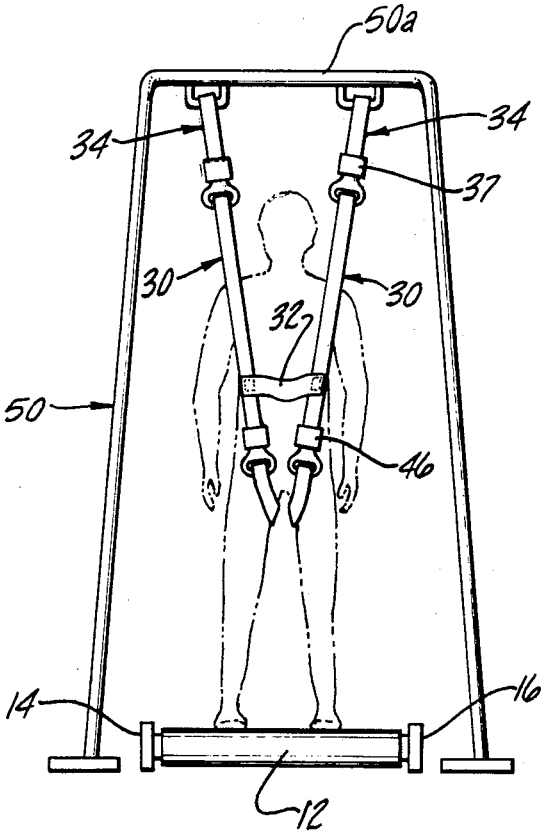
FIG. 3 is a rear view of the invention treadmill assembly showing a floor mounted frame supporting the safety harness.

In use, and as best seen in FIGS. 2 and 3, the straps are positioned such that the loop portions 38 of the straps pass through the groin of the user of the treadmill with the front sections 40 of the loop portions extending upwardly and passing generally adjacent the armpits of the user and over the shoulders of the user and with the catch band 32 positioned generally in the central region of the back of the user. For each individual user of the treadmill, female seatbelt members 37 are adjusted in known manner to vary the overall vertical height of the safety harness and female seatbelt members 46 are adjusted to vary the length of the loop portions of the straps to accommodate users of varying bodily configurations.

The invention safety harness allows the user of the treadmill to run freely on belt 12 with the user's hands grasping handle 20 in traditional manner. The configuration of the safety harness is such as to not interfere with the natural running movement of the user on the treadmill and yet functions in the event of collapse of the user due to overstressing to catch the user in a generally seated position and prevent the user from falling off of or onto the moving treadmill with consequent bodily injury. Specifically, if the user collapses while using the treadmill, the user's limp body is captured by the loop portions 38 and the catch band 32 with the loop portions 38 engaging through the groin and over the shoulders of the user and the catch portion 32 engaging the user's back and coacting with the loop portions to define a catch mechanism to catch the collapsed user in a generally seated position.

In the embodiment of the invention seen in FIG. 3, the overhead support means for the safety harness is provided by a separate floor mounted frame 50 which is positioned in straddling relation to the treadmill and which presents an overhead cross member 50*a* to which the upper ends of the upper strap portions 34 of the safety harness are suitably secured.

Figure 4:
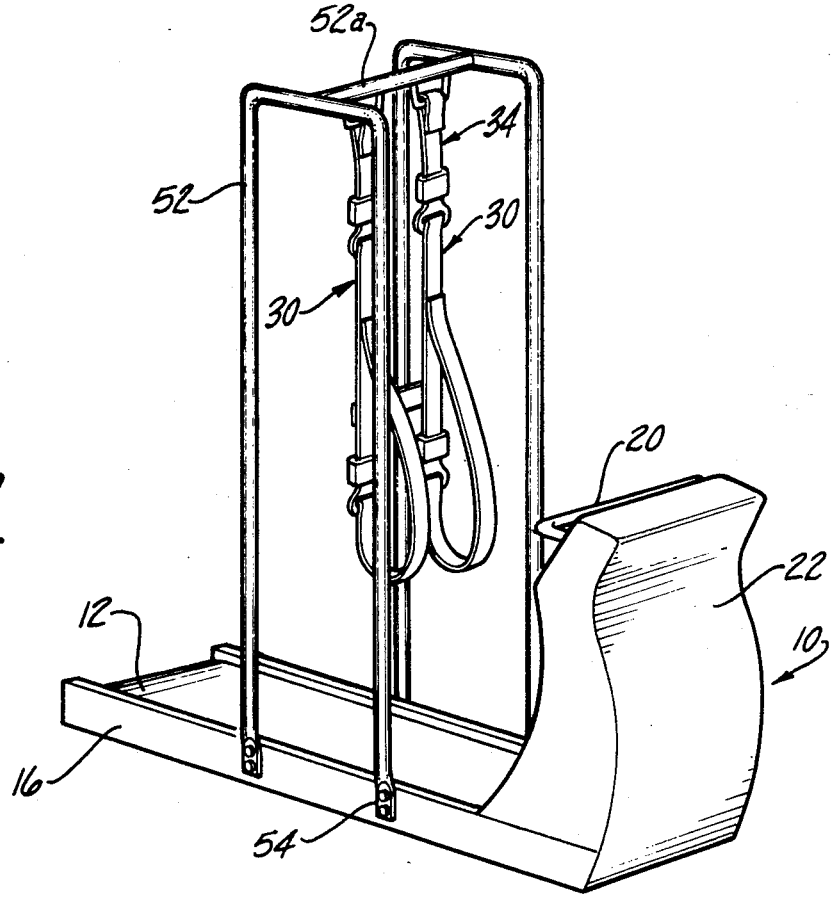
FIG. 4 is a perspective view of the invention treadmill assembly showing a treadmill mounted frame supporting the safety harness.

In the embodiment of the invention seen in FIG. 4, the overhead support means for the safety harness is provided by a frame structure 52 which is suitably secured by fastener means 54 to the side rails 14, 16 of the frame of the treadmill and which presents an overhead cross member 52*a* to which the upper ends of the upper strap portion 34 of the safety harness are suitably secured.

It will be seen that the invention treadmill assembly provides a simple, inexpensive and effective means of precluding injury to users undergoing stress tests on treadmills. The invention safety harness is readily installed, either directly in the ceiling over the treadmill or in a separate frame structure associated with the treadmill, and functions in an unobtrusive manner during normal usage of the treadmill while yet providing a safety harness that effectively catches the user in the event of collapse to prevent injury to the user.

Whereas preferred embodiments of the invention have been illustrated and described in detail, it will be apparent that various changes may be made in disclosed embodiments without departing from the scope or spirit of the invention.

We claim:

1. A safety apparatus for use with a motorized treadmill consisting of:

(A) support means positioned over said treadmill; and (B) a harness suspended from said support means, said harness including two spaced straps with each strap having first, second and third sections;

said first section attached at one end to said support means and at said opposite end to a first quick disconnect;

said second section attached at one end to said first quick disconnect and at said opposite end to a second quick disconnect, said second section being positioned adjacent the back of the user;

said third section attached at one end to said second quick disconnect and fixed at said opposite end to said second section between said first and second quick disconnects; and catch band means extending between and fixed to said second sections;

whereby, said third section is adapted to pass upwardly under the groin and over the shoulder of the user such that said harness does not support said person during operation of said treadmill but will function in response to collapse of the user while running on the treadmill to catch the user in a seated position and prevent the user from falling off the treadmill.

2. A safety apparatus according to claim 1 wherein:

F. said support means comprises means adapted to be secured in the ceiling over the treadmill.

3. A safety apparatus according to claim 2 wherein:

F. said support means comprises a frame structure extending upwardly and including a top cross member to which said straps are attached.

4. A safety apparatus according to claim 3 wherein:

G. said frame structure is floor mounted.

5. A safety apparatus according to claim 3 wherein:

G. said frame structure is mounted on and extends upwardly from said treadmill.

6. The safety apparatus of claim 1, wherein at least one of said quick disconnects and each of said spaced straps is adjustable to selectively adjust said straps to accommodate users of varying size.

7. A safety apparatus according to claim 6 wherein:

said spaced straps include a front section and a rear section; and said catch band extends transversely between the rear sections of said straps.

8. A safety apparatus according to claim 7, wherein:

said second quick disconnect is adjustable and is positioned beneath said catch band so that said harness may be adjusted in length to accommodate users of varying bodily configurations.

* * * * *